US007596831B2

(12) United States Patent
Faubert et al.

(10) Patent No.: US 7,596,831 B2
(45) Date of Patent: Oct. 6, 2009

(54) AUTOMOTIVE DOOR HINGE

(75) Inventors: Robert J. Faubert, Rochester Hills, MI (US); Richard A. Manning, Sterling Heights, MI (US); Raja Hazime, Dearborn Heights, MI (US); Kenneth E. Spieles, Shelby Township, MI (US); Robert R. Lazarevich, Rochester, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 509 days.

(21) Appl. No.: 11/399,262

(22) Filed: Apr. 6, 2006

(65) Prior Publication Data

US 2007/0234520 A1 Oct. 11, 2007

(51) Int. Cl.
*E05D 11/10* (2006.01)

(52) U.S. Cl. ..... 16/334; 16/287; 16/366; 16/357

(58) Field of Classification Search ..... 16/333–335, 16/343, 344, 347, 386, 287, 288, 366, 357, 16/362, 82, 85; 296/146.11, 146.12
See application file for complete search history.

(56) References Cited

U.S. PATENT DOCUMENTS 2,322,286 A * 6/1943 Dumelin ..... 16/358
2,791,794 A * 5/1957 Burns ..... 16/333
2,873,470 A * 2/1959 De Dona ..... 16/333
3,820,192 A * 6/1974 Nakano et al. ..... 16/334
4,285,098 A * 8/1981 Hicks et al. ..... 16/308
4,470,170 A * 9/1984 Gerteis ..... 16/345
4,672,715 A * 6/1987 Beckwith ..... 16/334
4,738,003 A * 4/1988 Mori et al. ..... 16/321
5,926,917 A * 7/1999 Gantz ..... 16/334
6,175,991 B1 * 1/2001 Driesman et al. ..... 16/366
6,382,705 B1 * 5/2002 Lang et al. ..... 296/146.12
6,681,448 B2 * 1/2004 Liang ..... 16/336
6,718,596 B2 * 4/2004 Kohlstrand et al. ..... 16/374
6,842,945 B2 * 1/2005 Hiramatsu ..... 16/366
7,032,953 B2 * 4/2006 Rangnekar et al. ..... 296/146.11

* cited by examiner

*Primary Examiner*—Chuck Y. Mah
(74) *Attorney, Agent, or Firm*—Ralph E. Smtih

(57) ABSTRACT

A hinge movably attaches a door to a frame member of a motor vehicle. The hinge includes a frame bracket configured for attachment to the frame member and including opposed sidewalls connected by a base, and a door bracket configured for attachment to the door and including opposed arms connected together by a bridge. A plurality of links pivotably and translatably connects the door bracket to the frame bracket. The links include a first link including second opposed arms pivotably connected to the frame bracket and to the door bracket and connected together by a second bridge, and a second link including third opposed arms pivotably connected to the frame bracket and to the door bracket and connected together by a third bridge.

5 Claims, 5 Drawing Sheets

AUTOMOTIVE DOOR HINGE

FIELD OF THE INVENTION

This invention relates generally to hinges, and more particularly to a motor vehicle door hinge having multiple pivotable hinge members.

BACKGROUND OF THE INVENTION

Typically, automotive door hinges have a fixed hinge member and one pivotable hinge member to enable a door of a motor vehicle to be pivoted between closed and open positions. In the closed position, the vehicle door is substantially parallel with the side of the vehicle and covers a door aperture. In the open position, the vehicle door is transversely oriented with respect to the side of the vehicle to leave the door aperture open. Conventional hinges are known to have at least two drawbacks.

The first drawback is related to the arc or path of the vehicle door as it is pivoted from the closed to the open position. Conventional hinges enable pivoting of the vehicle door in a rearward and inward motion wherein a front edge of the vehicle door moves rearward and into the door aperture. Such motion constitutes a limitation on vehicle designers in the design of the front edge of the vehicle door due to the possibility of interference with the side of the vehicle body when the vehicle door is pivoted between the closed and open positions. Thus, conventional hinges are typically not useable for a rear door having a leading edge with a double ninety-degree hem flange.

The second drawback is that such hinges are typically operative for pivoting an associated vehicle door only through about sixty (60) degrees of opening angle to provide access to the passenger compartment. Occasionally, greater access to the passenger compartment is desirable such as for ingress and egress of physically impaired passengers or loading and unloading of oversized cargo.

SUMMARY OF THE INVENTION

In accordance with the present invention, a hinge is provided for movably attaching a door to a frame member of a motor vehicle. The hinge includes a frame bracket, which is configured for attachment to the frame member and includes opposed sidewalls connected by a base. The hinge also includes a door bracket, which is configured for attachment to the door and includes opposed arms connected together by a bridge. The hinge further includes a plurality of links for pivotably and translatably connecting the door bracket to the frame bracket. The links include a first link having second opposed arms, which are pivotably connected to the frame bracket and to the door bracket and are connected together by a second bridge. The links further include a second link having third opposed arms, which are pivotably connected to the frame and door brackets and are connected together by a third bridge.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 2:
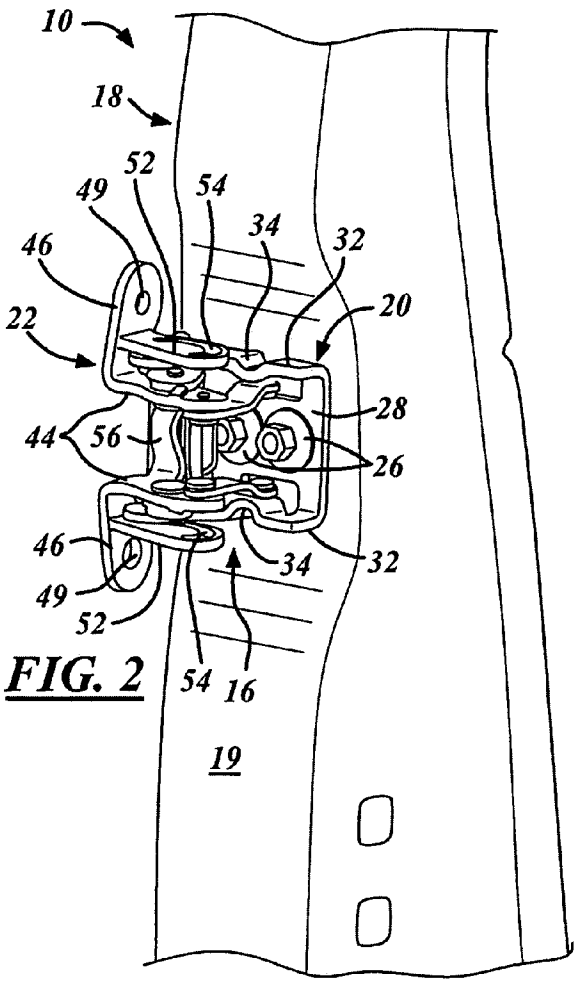
FIG. 2 is another perspective view of the hinge of FIG. 1, shown mounted to the B-pillar, as viewed from outside the vehicle with the rear door removed for clarity.
Figure 1:
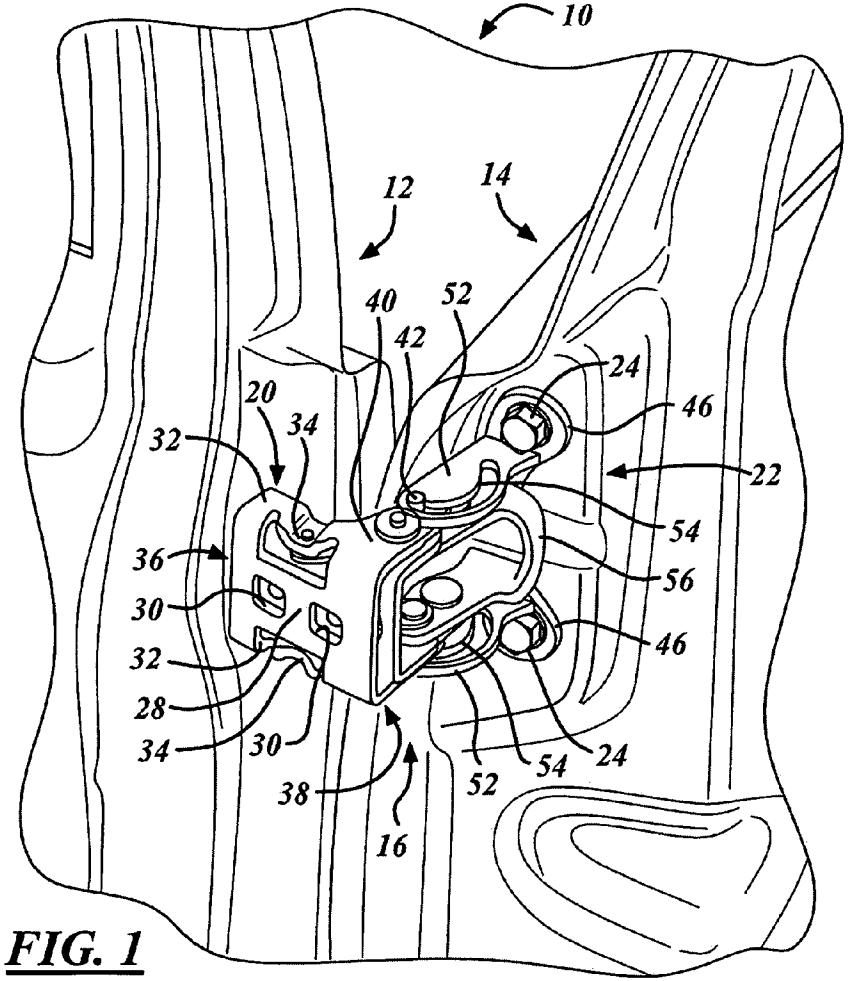
FIG. 1 is a perspective view according to a presently preferred form of a hinge mounted to a rear door of a motor vehicle, as viewed from inside the vehicle with a B-pillar frame member removed for clarity.

Referring now more particularly to the drawings, and especially to FIGS. 1 through 8, there is shown in FIG. 1 a portion of a motor vehicle body 10 including a rearward portion of a front door 12 for closing a front passenger aperture (not shown) of the body 10, a forward portion of a rear door 14 adjacent the front door 12 for closing a rear passenger aperture (not shown) of the body 10, and a hinge 16 for movably mounting the rear door 14 to a suitable frame member 18 of the body 10 such as a B-pillar, or the like, which is shown in FIG. 2. The B-pillar 18 is disposed relatively between the front door 12 and rear door 14.

Referring to FIGS. 1 and 2, the hinge 16 includes a frame bracket 20 for mounting to the B-pillar 18 and a door bracket 22 for mounting to the rear door 14. As shown in FIG. 1, the door bracket 20 mounts to the rear door 14 with any suitable fasteners 24 such as bolts, rivets, or the like. Likewise, as shown in FIG. 2, the frame bracket 20 mounts to the B-pillar 18 with any suitable fasteners 26.

Referring generally to FIGS. 1 through 5, the frame bracket 20 includes a generally planar base 28 with fastener passages 30 therethrough wherein the base 28 is preferably configured to mount against an outside surface 19 of the B-pillar 18. The frame bracket 20 further includes opposed sidewalls 32 having indented portions 34 between forward and rearward ends 36, 38 of the bracket 20 and further having raised shoulders 40 at the rearward end 38 of the frame bracket 20. Guide lugs 42 are provided on outboard sides of the raised shoulders 40 for guiding pivotable and translatable movement of the door bracket 22 as will be described further herein below.

The door bracket 22 includes opposed inboard arms 44 for indirectly mounting to the frame bracket 20 as will be described herein below. The opposed inboard arms 44 include link ends 46, oppositely disposed flanges 48 for mounting to the rear door 14 and including fastener passages therethrough 49, and staked portions 50 projecting from outboard surfaces of the opposed inboard arms 44 at a location between the link ends 46 and the opposed flanges 48.

The door bracket 22 further includes opposed outboard arms 52 extending in a generally forward direction from the opposed flanges 48 at locations along the flanges 48 between the fastener passages 49 and the opposed inboard arms 44. The opposed outboard arms 52 include guides 54, such as grooves, depressions, apertures, passages, or the like for cooperating with the lugs 42 of the frame bracket 20 for guiding the pivoting and translatory movement of the door bracket 22 with respect to the frame bracket 20. Finally, the door bracket 22 also includes a bridge 56, which connects the opposed inboard arms 44 for rigidity and may act as a stopper as will be described herein below.

Figure 3:
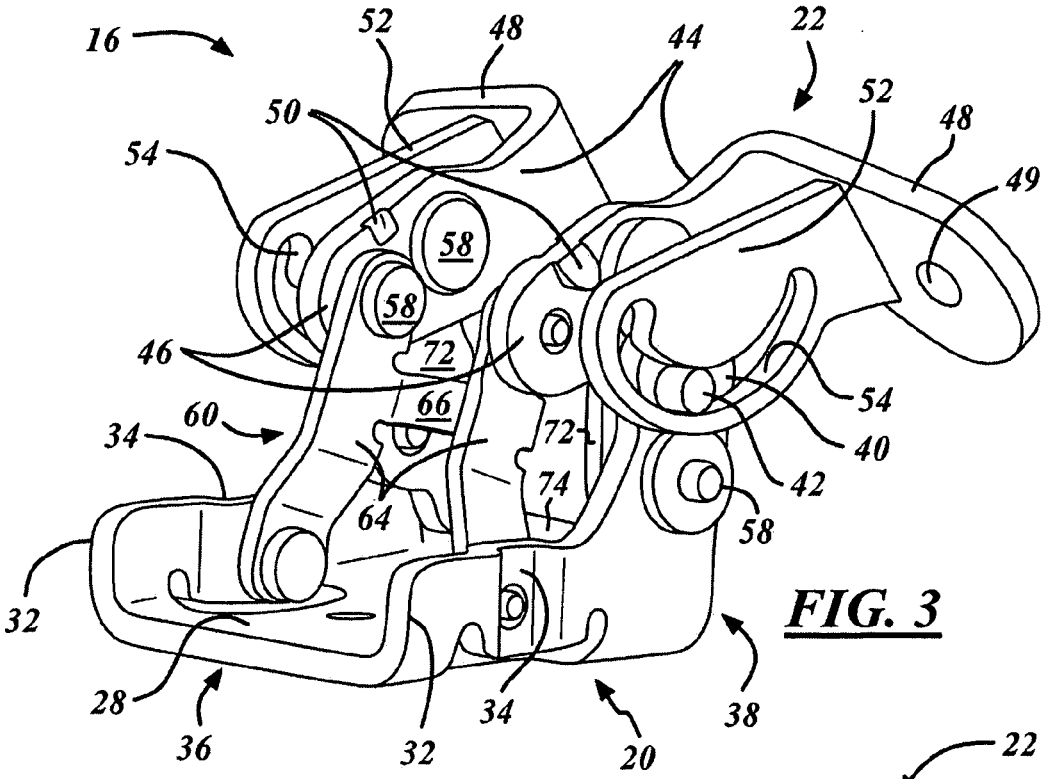
FIG. 3 is another perspective view of the hinge of FIG. 1 apart from the vehicle and in a partially open position.
Figure 4:
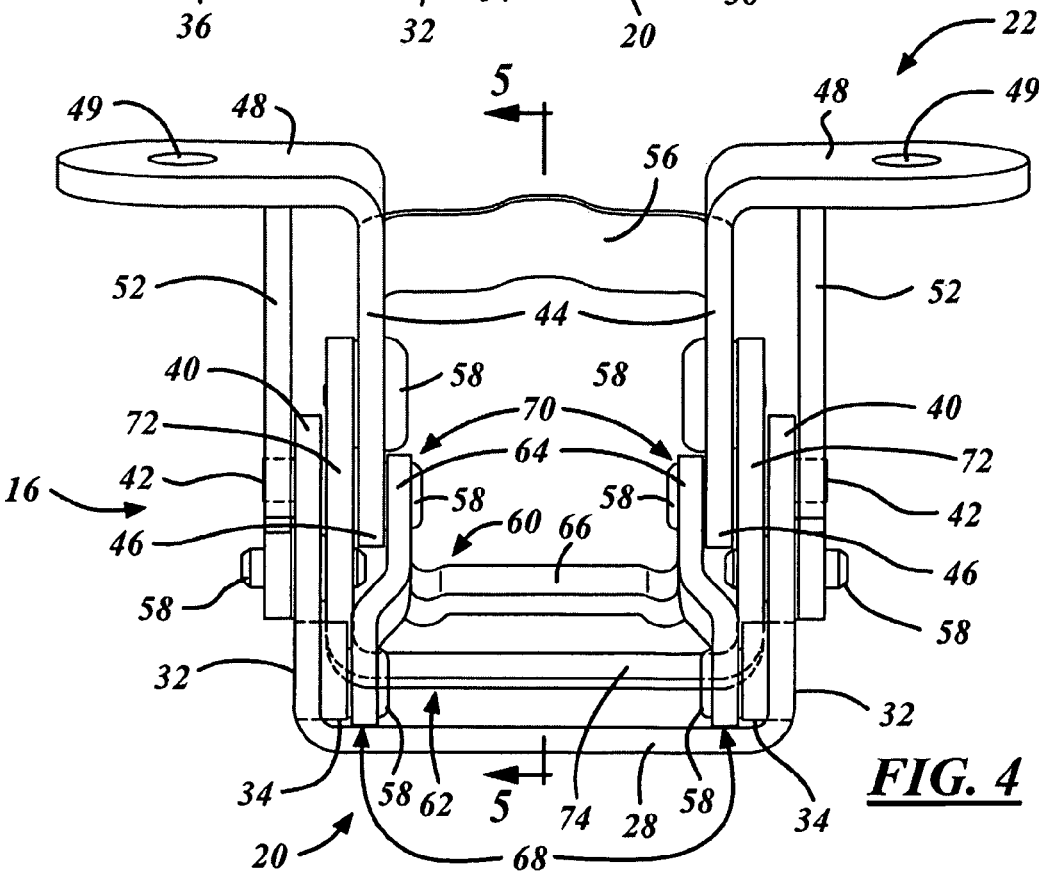
FIG. 4 is an end view of the hinge of FIG. 1 shown in a fully open position.
Figure 5:
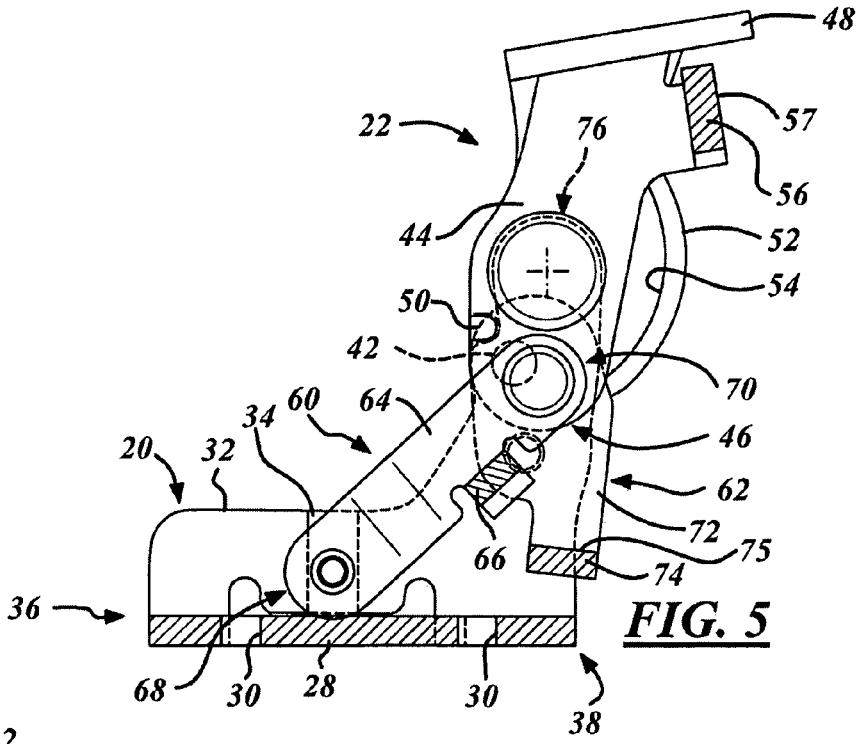
FIG. 5 is a cross-sectional view of the hinge of FIG. 4, taken along line 5-5 thereof.

Referring to FIGS. 3 through 5, the hinge 16 includes multiple pivotable hinge members including the door bracket 22 as well as pivotable links provided to pivotably and translatably connect the door bracket 22 to the frame bracket 20. The pivotable links are pivotably connected to the brackets 20, 22 using any suitable pivotable connecting devices 58 such as carriage bolts, rivets, pins, integral projections, or the like. The pivotable links include a first link 60 pivotably connected to the frame bracket 20 and to the door bracket 22, and a second link 62 pivotably connected to the frame bracket 20 and to the door bracket 22. The first link 60 is located relatively forward with respect to the second link 62, and is generally located inboard of the door bracket 22 whereas the second link 62 is generally located outboard of the door bracket 22.

The first link 60 is preferably substantially H-shaped having opposed arms 64 connected together by a bridge 66 for providing rigidity to the link 60. At a pillar end 68 of the link 60, the opposed arms 64 are pivotably mounted by the pins 58 to the frame bracket 20 between the indented portions 34 thereof. At an oppositely disposed door end 70 of the link 60, the opposed arms 64 are pivotably connected by the pins 58 to the link ends 46 of the door bracket 22 between the opposed inboard arms 44 thereof. The bridge portion 66 of the first link 60 is disposed between the pillar end 68 and door end 70 of the link 60 on a rearward side thereof.

The second link 62 is preferably substantially U-shaped has opposed arms 72 connected together by a bridge 74 for providing rigidity to the link 62 and may act as a stopper as will be described herein below. The bridge 74 defines a pillar end of the second link 62 and at an oppositely disposed door end 76 of the link 62, the opposed arms 72 of the second link 62 are pivotably connected by the pins 58 to the opposed inboard arms 44 of the door bracket 22 at a location between the opposed flanges 46 and link ends 46 thereof on outboard sides of the opposed inboard arms 44. The second link 62 is pivotably connected to the shoulder portions 40 of the frame bracket 20 adjacent inboard sides thereof and at a location between the bridge 74 and the door end 76 of the second link 62.

Figure 6:
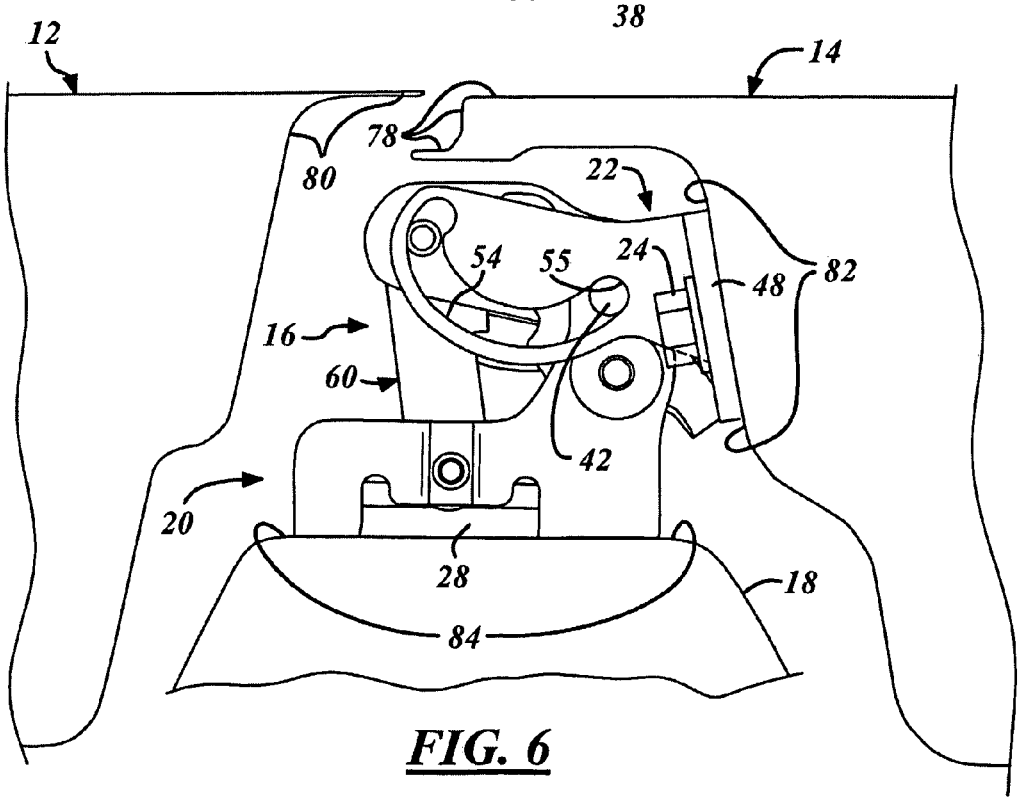
FIG. 6 is a fragmentary top view of the hinge of FIG. 1 shown mounted to the rear door adjacent a front door and with the B-pillar removed.

As shown in FIG. 6, the hinge 16 may be used with the rear door 14, which has, at a forward portion thereof, a double ninety-degree hem flange 78 that overlaps with a single ninety-degree hem flange 80 of the front door 12 at a rearward portion thereof. Accordingly, the hinge 16 is not visible to an observer looking from outside the vehicle 10 toward the inside. The opposed flanges 48 of the door bracket 22 mount against a forwardly-disposed inside surface 82 of the rear door 14, and the base 28 of the frame bracket 20 mounts against an outside surface 19 of the B-pillar 18. The hinge 16 enables the door 14 to move in pivotable and translatory motion with respect to the B-pillar 18, so as to avoid interference of the double ninety-degree hem flange 78 with the single ninety-degree hem flange 80 of the front door 12.

In the closed position depicted in FIG. 6, relative motion between the pillar and door brackets 20, 22 toward a further closed position is prevented, wherein the fixed lugs 42 of the frame bracket 20 locate against a rear end 55 of the guide passage 54 of the door bracket 22. In other words, the lugs 42 and rear end 55 of the bracket 22 cooperate as stoppers to define a closed position of the door 14. Also, referring to the cross section of FIG. 5 but when the hinge 16 is in a closed position, a surface 57 of the bridge 56 of the door bracket 22 may locate against a surface 75 of the bridge 74 of the second link 62. Accordingly, the bridges 56, 74 cooperate as stoppers for additionally defining the closed position of the door 14. From this position, the door 14 may not be further closed, but may be opened.

Figure 7:
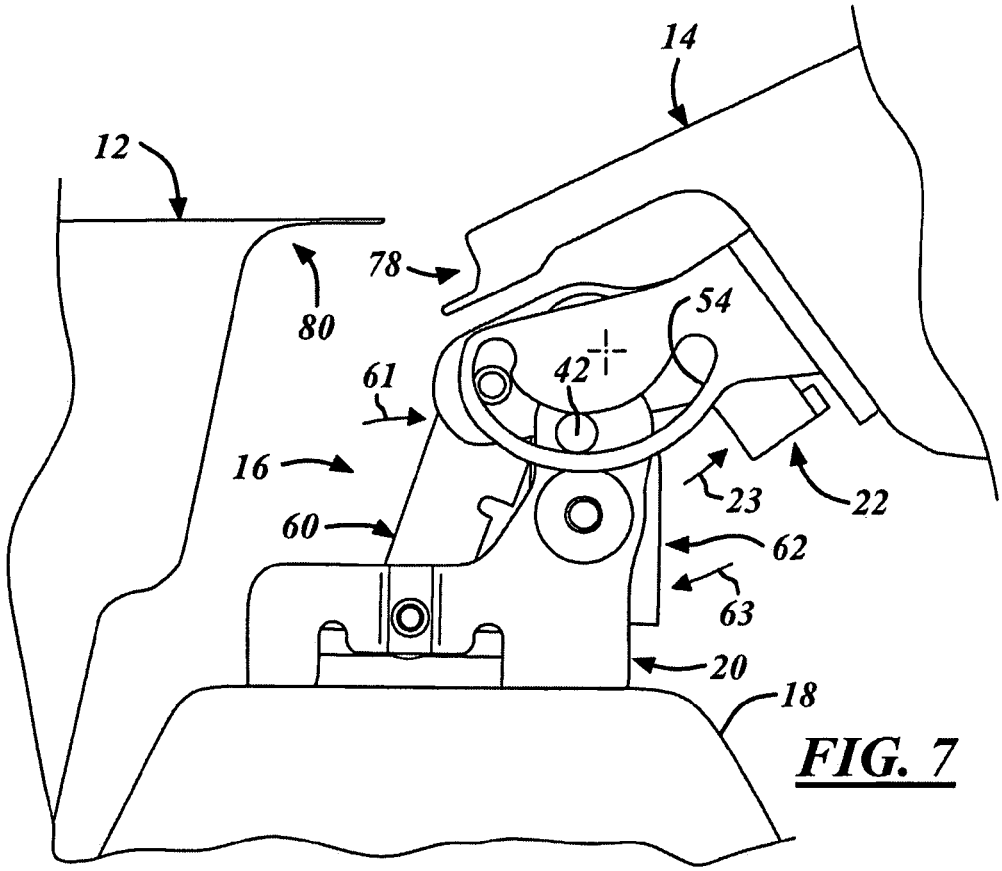
FIG. 7 is a fragmentary top view similar to that of FIG. 6 but with the hinge and rear door in a partially open position.

FIG. 7 illustrates the hinge 16 moved to a first partially open position, wherein the door 14 has translated, as well as pivoted through about 26 degrees from the closed position of FIG. 6. During opening of the hinge 16 and door 14, the frame bracket 20 remains stationary, the pivotable links 60, 62 rotate in a clockwise direction as shown by arrows 61, 63, and the door bracket 22 moves in a counter-clockwise direction as shown by arrow 23. The pivoting and translatory motion of the door bracket 22 is preferably dictated by the configuration and attachment of the links 60, 62 but is preferably guided and supported by the lugs 42 of the frame bracket 20 within the guides 54 of the door bracket 22.

Figure 8:
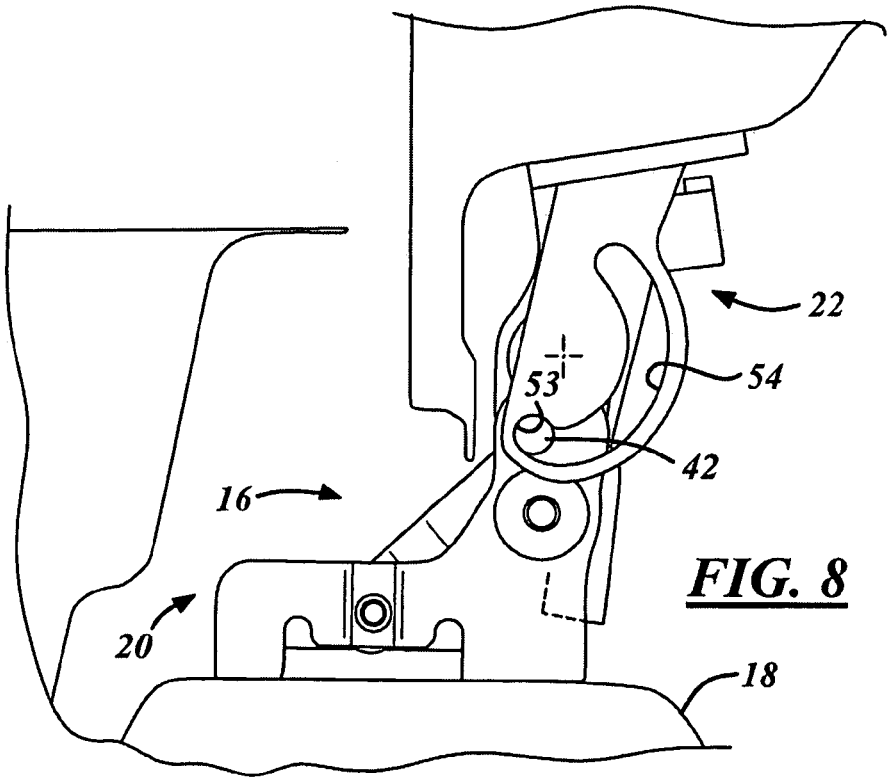
FIG. 8 is a fragmentary top view similar to that of FIG. 7 but with the hinge and rear door in a fully open position.

FIG. 8 illustrates the hinge 16 moved to a fully open position, wherein the door 14 has translated and pivoted through about 90 degrees from the closed position of FIG. 6. In this position, relative motion between the pillar and door brackets 20, 22 toward a further open position is prevented, wherein the fixed lugs 42 of the frame bracket 20 locate against corresponding forward ends 53 of the guide passage 54 of the door bracket 22. Thus, the lugs 42 and forward ends 53 of the bracket 22 may cooperate as stoppers to define a fully open position of the door 14. Also, referring to the cross section of FIG. 5 when the hinge 16 is in its open position, the staked portions 50 of the door bracket 22 may locate against corresponding forward edges of the arms 72 of the second link 62. Accordingly, the staked portions 50 and the forward edges of the arm 72 cooperate as additional stoppers for further defining the open position of the door 14. From this position, the door 14 may not be further opened, but maybe closed.

Figure 9:
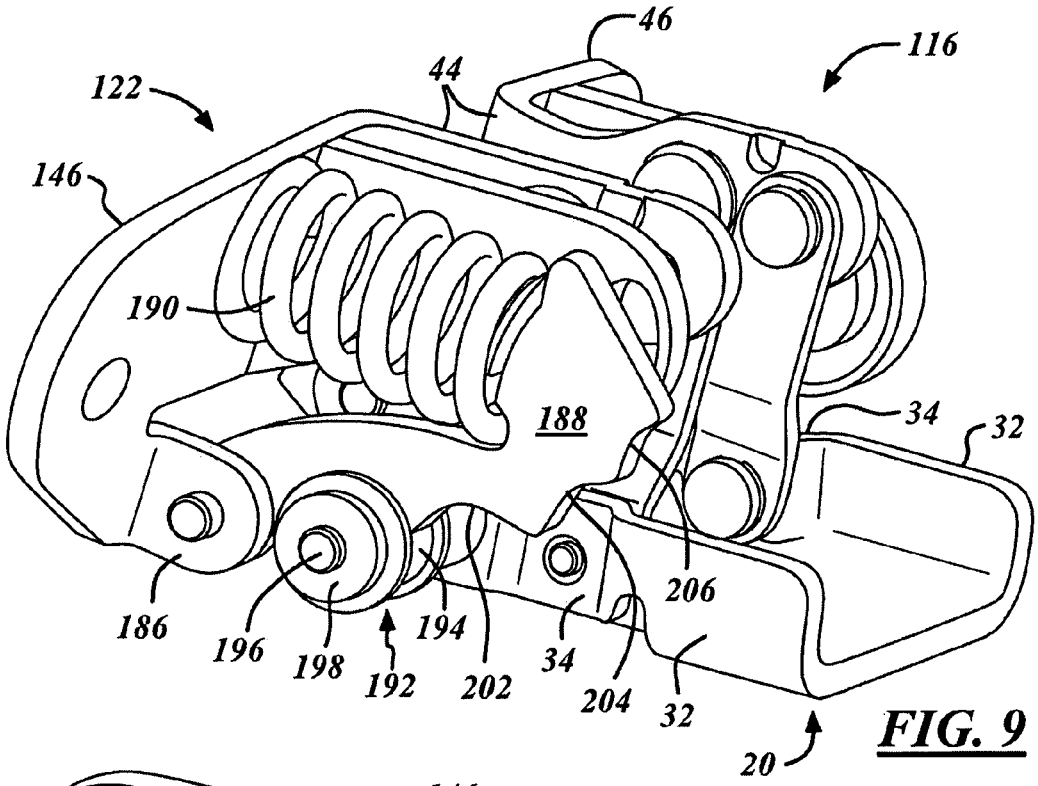
FIG. 9 is a perspective view according to another presently preferred form of a hinge having a spring-loaded cam mechanism.
Figure 10:
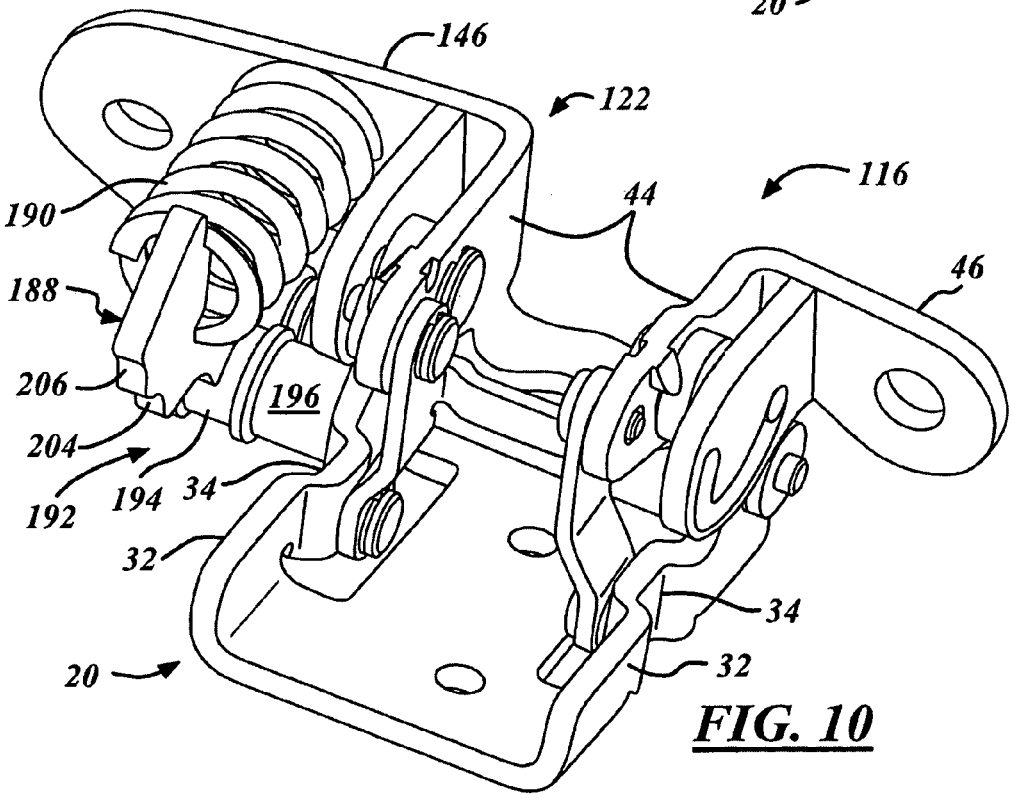
FIG. 10 is another perspective view of the hinge of FIG. 9.

FIGS. 9 and 10 illustrate another presently preferred embodiment of a hinge 116. The hinge 116 is preferably a lower hinge used in conjunction on the same rear door 14 with the hinge 16 of FIGS. 1 through 8 that is preferably an upper hinge. This embodiment is similar in many respects to the embodiment of FIGS. 1 through 8 and like numerals between the embodiments generally designate like or corresponding elements throughout the several views of the drawing figures. Additionally, the description of the common subject matter may generally not be repeated here.

The hinge 116 includes the frame bracket 20 for mounting to the B-pillar 18 and a door bracket 122 for mounting to the rear door 14. The door bracket 122 includes oppositely disposed mounting flanges including one of the flanges 46 on one side thereof and an elongated flange 146 on an opposite side.

The elongated flange 146 includes a bent tab 186, which pivotably carries a pivotable cam arm 188. A yieldable biasing member 190, such as a compression spring or the like is interposed between the pivotable cam arm 188 and the elongated flange 146 for yieldably biasing the pivotable cam arm 188 away from the elongated flange 146 and into engagement with a rotatable cam follower 192. Accordingly, the cam arm 188, yieldable biasing member 190, and cam follower 192 define a spring-loaded cam mechanism interposed between the frame bracket 20 and door bracket 22.

The cam follower 192 is carried by one of the sidewalls 32 of the frame bracket 20 at a location rearward of the indented portions 34 thereof. The cam follower 192 includes, a roller 194, which may be rotatably mounted to a shaft 196 and retained thereto with any suitable retainer 198 such as a snap ring, clip, or the like. The cam arm 188 includes a plurality of detents including a closed detent shown in FIGS. 9 and 10 as occupied by the roller 194 of the cam follower 192, a first partially open detent 202 adjacent the closed detent for defining a first partially open hinge position, a second partially open detent 204 adjacent the first partially open detent 202 for defining a second partially open hinge position, and a fully open detent 206 for defining a fully open hinge position.

The plurality of detents define several different positions of the bracket 122. The closed detent preferably corresponds to a position wherein the door bracket 122 is in its fully closed position as described herein above. The first partially open detent 202 preferably corresponds to the first partially open position wherein the door bracket 122 has moved through about 26 degrees of rotation. The second partially open detent 204 preferably corresponds to a second partially open position wherein the door bracket 122 has moved through about 68 degrees of rotation. The fully open detent 204 preferably corresponds to a fully open position wherein the door bracket 122 has moved through about 90 degrees of rotation.

Accordingly, the plurality of detents also defines several positions of the door 14 to which the bracket 122 is attached, wherein the first and second partially open positions of the bracket 122 correspond to partially open positions of the door 14. Accordingly, the door 14 may be held in place by the hinge 116 in any of the open or partially open detent positions under a force corresponding to the force imposed by the biasing member 190 on the cam arm 188. The door 14 may be moved from any of such positions by overcoming such forces to move the cam arm 188 out of detent with respect to the follower 194.

Thus, as the door bracket 22 of the hinge 16 is moved under sufficient force from its fully closed position to its fully open position, the door bracket 22 preferably simultaneously translates and pivots, and the cam arm 188 moves over the cam follower 192 such that the cam follower 182 moves from the closed detent, into and then out of the first partially open detent 202, into and then out of the second partially open detent 204, and finally into the fully open detent 206. In the door position corresponding to the fully open detent 206, the door 14 is preferably open to about 90 degrees with respect to the side of the vehicle body 10. Accordingly, the hinges 16, 116 enable greater access to the passenger compartment such as for ingress and egress of physically impaired passengers, or for loading and unloading of oversized cargo.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A motor vehicle body comprising:

a front door;

a rear door adjacent the front door having a leading edge with a double ninety-degree hem flange;

a B-pillar disposed between the front and rear doors; and a hinge for movably attaching the rear door to the B-pillar and including:

a frame bracket configured for attachment to the B-pillar and including opposed sidewalls connected by a base;

a door bracket configured for attachment to the door and including first door bracket opposed arms connected together by a first bridge; and a plurality of links pivotably and translatably connecting the door bracket to the frame bracket and comprising:

a first link including second opposed arms pivotably connected to the frame bracket and to the door bracket and being connected together by a second bridge;

a second link including third opposed arms pivotably connected to the frame bracket and to the door bracket and being connected together by a third bridge; and wherein the frame bracket further includes a guide lug extending in a generally outboard direction from an outboard side of each one of the opposed sidewalls of the frame bracket; and wherein the door bracket further includes second door bracket opposed arms being positioned outboard with respect to the first door bracket opposed arms and having a guide therein cooperating with a corresponding one of the guide lugs of the frame bracket guiding the pivotable and translatable motion of the door bracket with respect to the pillar bracket.

2. The motor vehicle body of claim 1, further comprising a spring-loaded cam mechanism interposed between the frame bracket and door bracket and including:

a cam arm pivotably carried by the door bracket and including at least one detent;

a rotatable cam follower carried by the frame bracket including a roller rotatably mounted to a shaft carried by the frame bracket and retained thereto with a retainer; and a yieldable biasing member to bias the cam arm into engagement with the cam follower;

wherein as the door bracket is moved from a fully closed position to a fully open position the door bracket translates and pivots, and the cam arm moves over the cam follower such that the cam follower moves into and our of the at least one detent.

3. The motor vehicle body of claim 2, wherein the at least one detent of the cam arm includes a closed detent, a first partially open detent, a second partially open detent, and a fully open detent, wherein as the door bracket is moved from the fully closed position to the fully open position the cam arm moves over the cam follower such that the cam follower moves out of the closed detent, into and then out of the first partially open detent, into and then out of the second partially open detent, and finally into the fully open detent, and wherein the first partially open detent corresponds to a position wherein the door bracket has moved through about 26 degrees of rotation from the closed detent position, the second partially open detent corresponds to a position wherein the door bracket has moved through about 68 degrees of rotation from the closed detent position, and the fully open detent corresponds to a position wherein the door bracket has moved through about 90 degrees of rotation from the closed detent position.

4. The motor vehicle body of claim 1 wherein the first link is substantially H-shaped, and the second link is substantially U-shaped.

5. The motor vehicle body of claim 1 wherein each guide comprises an arcuate and elongate slot formed in a corresponding one of the opposed outboard arms of the second door bracket.

* * * * *